US011674265B2

(12) United States Patent
Lindblom et al.

(10) Patent No.: US 11,674,265 B2
(45) Date of Patent: Jun. 13, 2023

(54) CENTER RING PROVIDED WITH WINGS

(71) Applicant: VALMET AB, Sundsvall (SE)

(72) Inventors: Thommy Lindblom, Hägersten (SE); Christer Hedlund, Katrineholm (SE)

(73) Assignee: VALMET AB, Sundsvall (SE)

( * ) Notice: Subject to any disclaimer, the term of this patent is extended or adjusted under 35 U.S.C. 154(b) by 177 days.

(21) Appl. No.: 17/166,211

(22) Filed: Feb. 3, 2021

(65) Prior Publication Data

US 2021/0246610 A1 Aug. 12, 2021

(30) Foreign Application Priority Data

Feb. 12, 2020 (SE) ..... 2050147-4

(51) Int. Cl.
*D21B 1/14* (2006.01)
*D21D 1/30* (2006.01)

(52) U.S. Cl.
CPC ..... *D21D 1/306* (2013.01); *D21B 1/14* (2013.01)

(58) Field of Classification Search
CPC ..... D21D 1/306
USPC ..... 162/261; 241/245, 291
See application file for complete search history.

(56) References Cited

U.S. PATENT DOCUMENTS

| | | | | |
|---|---|---|---|---|
| 4,221,631 | A | 9/1980 | Hellerqvist et al. | |
| 4,725,336 | A * | 2/1988 | Fisher | D21D 1/30 162/23 |
| 9,943,852 | B2 * | 4/2018 | Lönngren | D21D 1/30 |
| 2007/0164143 | A1 * | 7/2007 | Sabourin | D21D 1/306 241/297 |

FOREIGN PATENT DOCUMENTS

| | | | |
|---|---|---|---|
| SE | 539 119 | C2 | 4/2017 |
| WO | WO-2018/160115 | A1 | 9/2018 |
| WO | WO-2018/236269 | A1 | 12/2018 |

OTHER PUBLICATIONS

Search Report issued in Swedish Patent Application No. 2050147-4 dated Oct. 16, 2020, 3 pages.

* cited by examiner

*Primary Examiner* — Jacob T Minskey
(74) *Attorney, Agent, or Firm* — Foley & Lardner LLP

(57) ABSTRACT

The invention relates to a center ring arrangeable on a refining disc of a defibrator for refining of fibrous material, wherein said center ring comprises a circumferential outer surface, a circumferential inner surface and a centrally located through-hole adapted to receive fibrous material fed from a feeding device, wherein said outer surface is provided with a circumferentially running groove opening up on the outer surface and being adapted to collect steam produced during operation of said defibrator, and wherein the center ring further comprises a plurality of wings provided on said inner surface and a number of channels extending from said groove to the positions on said inner surface where said wings are provided.

10 Claims, 7 Drawing Sheets

CENTER RING PROVIDED WITH WINGS

TECHNICAL FIELD

The proposed technology generally relates to a center ring for a defibrator of fibrous material. More specifically it relates to a center ring design that enables an improved separation of steam flow and material flow during use of the defibrator. Also disclosed is a refining disc comprising such a center ring as well as a defibrator comprising such a refining disc.

BACKGROUND

A defibrator is a thermo-mechanical pulping refiner, in which pulp material, such as wood chips or other lignocellulose-containing fibrous material, is ground or processed between two refining discs in a steam-containing environment. The refining discs often contain a rotating grinding disc, commonly referred to as a rotor, and a stationary disc referred to as a stator, which is arranged opposite the rotor. There are however alternative designs, it is for example possible to have two rotating discs opposing one another. The refining discs are aligned along a pulp-feeding axis, and the rotating disc is arranged on a rotatable axis that can be rotated relative to the other disc by means of, e.g., an electrical motor. The refining surfaces, i.e. the surfaces that oppose one another, of the refining discs are often provided with refining segments, which are provided with refining bars and grooves having different sizes and orientations. The refining segments are provided in order to improve the grinding action on the fibers. During operation of a defibrator, the material to be refined is transported to a refining gap, which is defined as the gap between the refining surfaces of the opposing refining segments. The material is then processed by, e.g., the refining segments typically located near the circumference of the refining discs. Wood chips or similar fibrous materials are fed via a feeding channel along the pulp feeding axis through a hole in one of the discs, usually the stator, and into the gap or the central space between the discs. Wood chips fed into the center of the refining discs are displaced towards the circumference of the discs through the impact of a centrifugal force and the fibrous material will emerge in the refining gap where the grinding of the fibrous material takes place. The structures provided on the refining segments, i.e. the bars and grooves usually have a finer pattern closer to the circumference of the discs.

During normal use of a defibrator, the refining or defibration action will cause friction, which in turn will heat up the processed material. Since lignocellulosic material, e.g., wood pulp, naturally contains water the friction will heat up the water and steam will be created. The generated steam may leave the refining space together with the refined material, but it is also possible that the steam flows backwards towards the location where the material is fed into the defibrator. The created steam may have a substantial speed and display an irregular movement, whereby it could severely affect the smoothness of the material flow. The steam may interact with material flow and perturb the intended paths for the material flow. All in all, it might affect the material flow in such a way that the material flow over the gap becomes irregular and that different parts of the material will be processed differently. This will have negative consequences when it comes to the quality of the pulp. It is therefore necessary to find improvements that could reduce the negative action of interacting steam and material during a defibrator run. A particular purpose of the proposed technology is therefor to provide mechanisms that at least alleviate some of the problems that are associated with the unwanted interaction between the steam and the material flow.

There have been attempts within the art to alleviate the problems associated with the generation of steam between the refining discs. These problems have involved the withdrawal of steam from the central space between the refining discs. U.S. Pat. No. 4,221,631, for example discloses a disc-refiner comprising a pair of refining discs having refining segments provided with passageways extending through the segments from the refining space to the rear surface of the segments to allow steam created in the refining space to evacuate the refining gap.

In SE539119, having the same applicant as the present disclosure, there is disclosed a center ring provided with steam-outlet openings that allow back-travelling steam to leave the central area before an interaction with material fed into the refining gap. Despite these efforts there is still a need in the art to further improve the evacuation of steam from the refining space or gap of the defibrator.

SUMMARY

It is an object of the proposed technology to provide a center ring that can be arranged on a refining disc of a defibrator for refining of fibrous material where the center ring has improved steam-removal features.

There is a particular object to provide a center ring with improved steam-removal features that can be used during a substantial running time without having to clean the center ring.

There is an additional object to provide a refining disc comprising a center ring having improved steam-removal features.

There is still another object to provide a double-disc defibrator having a refining disc comprising a center ring having improved steam-removal features.

These and other objects are met by embodiments of the proposed technology.

According to a first aspect, there is provided a center ring arrangeable on a refining disc of a defibrator for refining of fibrous material, wherein said center ring comprises a circumferential outer surface, a circumferential inner surface and a centrally located through-hole adapted to receive fibrous material fed from a feeding device, wherein said outer surface is provided with a circumferentially running groove opening up on the outer surface and being adapted to collect steam produced during operation of said defibrator, and wherein the center ring further comprises a plurality of wings provided on said inner surface and a number of channels extending from said groove to the positions on said inner surface where said wings are provided.

According to a second aspect there is provided a refining disc comprising a center ring according to the first aspect.

According to a third aspect there is provided a double disc refiner comprising a refining disc according to the second aspect.

Embodiments of the proposed technology enables a separation between a material flow and a back-travelling steam flow. This ensure a smooth material flow towards the material processing areas on a refiner disc in a defibrator. This smooth material flow will in turn yield a more evenly processed material which leads to an improved quality of the defibrated fibrous material.

Other advantages will be appreciated when reading the detailed description.

BRIEF DESCRIPTION OF THE DRAWINGS

The embodiments, together with further objects and advantages thereof, may best be understood by making reference to the following description taken together with the accompanying drawings, in which.

DETAILED DESCRIPTION

Throughout the drawings, the same reference designations are used for similar or corresponding elements.

Generally, all terms used herein are to be interpreted according to their ordinary meaning in the relevant technical field, unless a different meaning is clearly given and/or is implied from the context in which it is used. All references to a/an/the element, apparatus, component, means, step, etc. are to be interpreted openly as referring to at least one instance of the element, apparatus, component, means, step, etc., unless explicitly stated otherwise. The steps of any methods disclosed herein do not have to be performed in the exact order disclosed, unless a step is explicitly described as following or preceding another step and/or where it is implicit that a step must follow or precede another step. Any feature of any of the embodiments disclosed herein may be applied to any other embodiment, wherever appropriate. Likewise, any advantage of any of the embodiments may apply to any other embodiments, and vice versa. Other objectives, features and advantages of the enclosed embodiments will be apparent from the following description.

Figure 1:
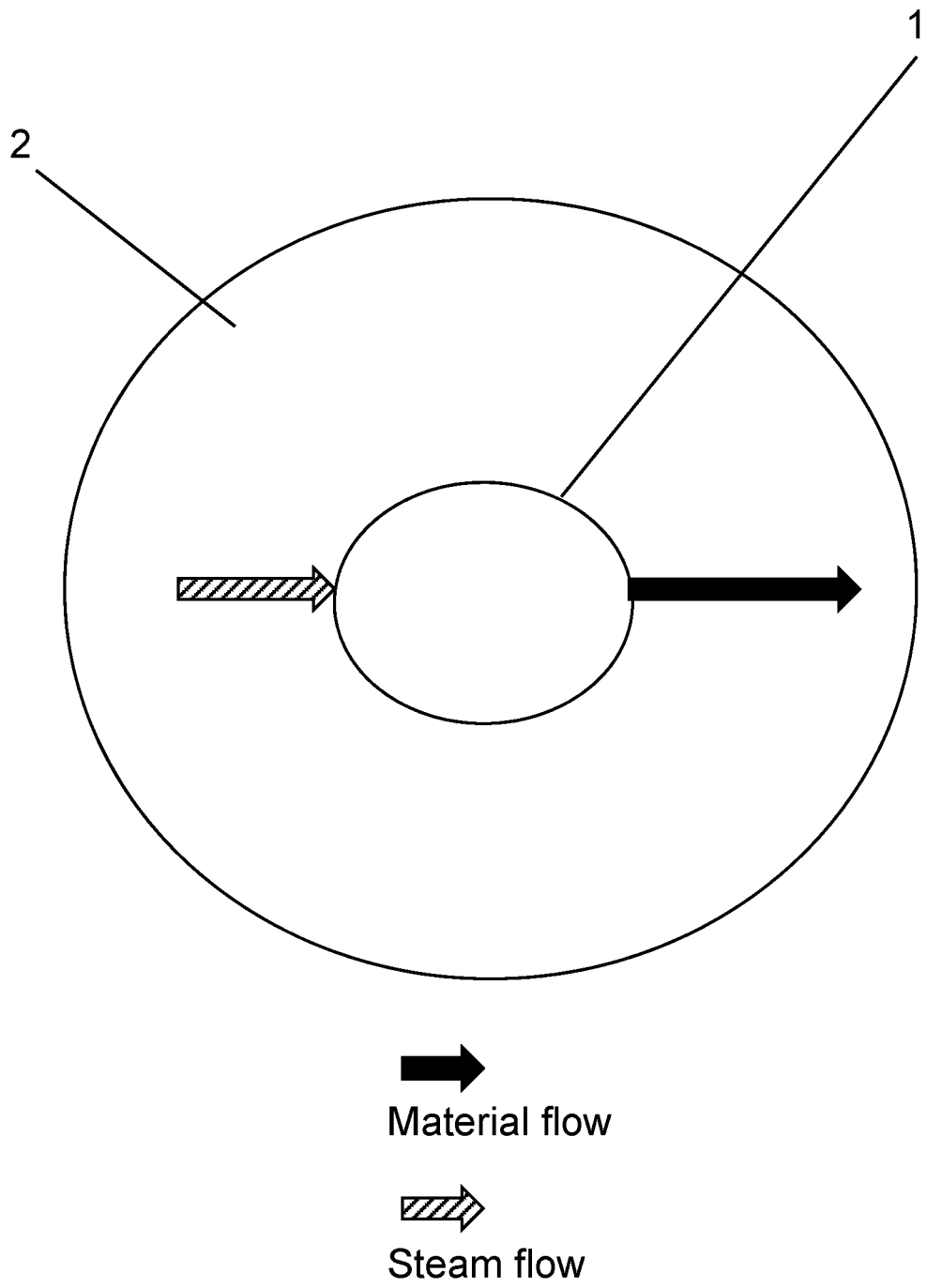
FIG. 1 is a schematic illustration of a refining disc provided with a center ring according to known designs.

For a better understanding of the proposed technology, it may be useful to begin with a brief overview of the technical problem addressed herein. To this end reference is made to FIG. 1, which illustrates a front side-view of a refining disc 2 provided with a center ring 1. This refining disc is, during use in a defibrator, arranged opposite another refining disc so as to create a refining area or refining gap in the intermediate area. The material is fed into the area through the center of the center ring. Here the material is distributed towards the peripheral sections of the refining gaps. These peripheral sections are often provided with refining segments having protruding or depressed structures defining so called bars and grooves. These bars and grooves make the defibration more efficient. When the refining discs perform work on the material a lot of steam is produced. The steam will aim to evacuate the working area, due to the high pressure present there, and it will therefore move back towards the inlet area in the center of the center ring 1, see FIG. 1. In this area the produced steam, having a substantial speed and displaying irregular movements, may interact with the incoming material and perturbate the material movement path. This may negatively affect the material flow into the refining gap and/or towards the peripheral sections on the refining discs. The material flow should preferably be smooth to ensure that all parts of the material gets comparably processed. Having a lot of steam perturbing its path is thus detrimental to the end quality of the processed material. It is therefore needed a mechanism that could separate at least part of the steam flow from the material flow. The proposed technology provides such a mechanism.

The proposed technology provides in fact a center ring 1 that has been provided with certain structures that enables steams produced in the refining gap to enter this area with a reduced impact on any incoming material flow.

To achieve this the proposed technology provides a center ring 1 arrangeable on a refining disc of a defibrator for refining of fibrous material, wherein the center ring 1 comprises an outer surface **6*b*, an inner surface 6*a* and a centrally located through hole adapted to receive fibrous material fed from a feeding device, wherein the outer surface 6*b* is provided with a circumferentially running groove 16 opening up on the outer surface 6*b* and being adapted to collect steam produced during operation of the defibrator 10, and wherein the center ring 1 further comprises a plurality of wings 3 provided on the inner surface 6*a* and a number of open channels 17 extending from the groove 16 to the positions on the inner surface 6*a* where the wings 3** are provided.

Figure 2:
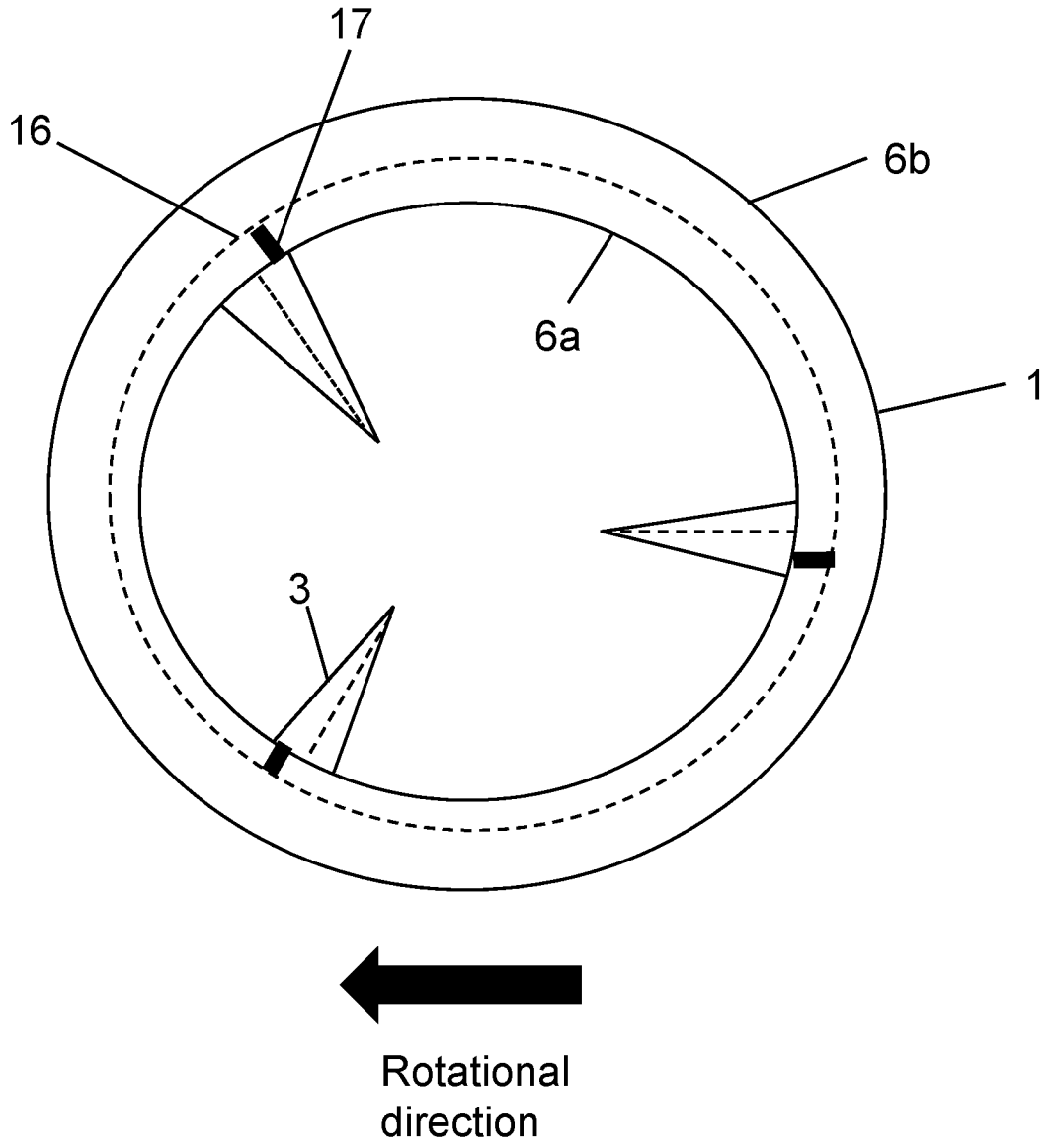
FIG. 2 is a schematic illustration of a center ring provided with wings and channels according to the proposed technology.
Figure 3:
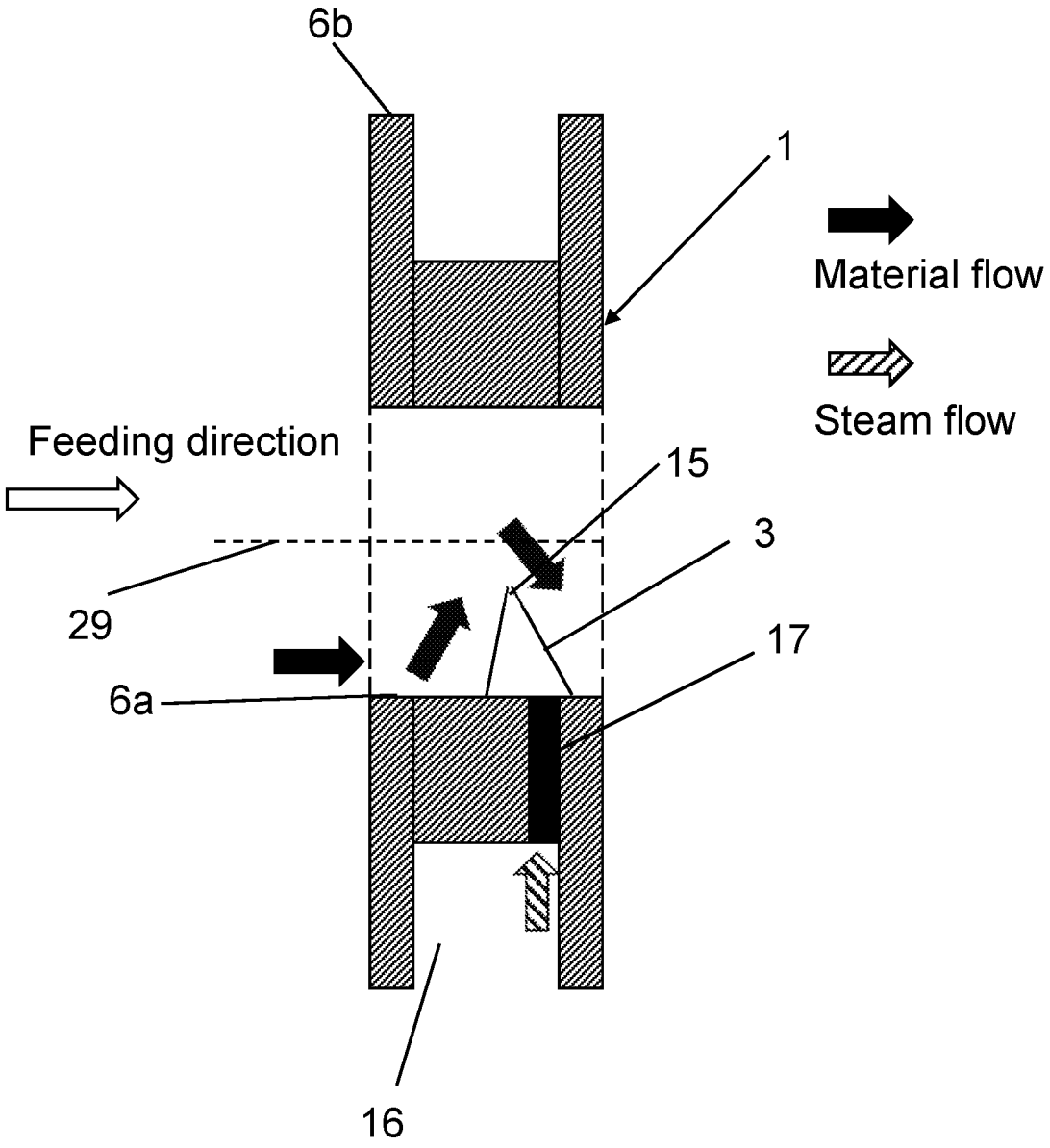
FIG. 3 is a schematic illustration of an embodiment of a center ring according to the proposed technology. The illustration is a cross-sectional side-view of the center ring.

FIG. 2 is a schematic front view, i.e., as viewed from the inlet of the material in the refining gap, of such as center ring 1. The center ring 1 is provided with a set of wings 3 (three wings in FIG. 1) provided on the surface of the center ring that is in contact with the material flow, i.e. the inner surface **6*a* on the center ring. The wings 3 are intended to lift the incoming material so as to create a more or less material free section behind the wings 3. The center ring 3 is moreover provided with a circumferential groove 16 that provides a pocket for collecting steam that has travelled back towards the center ring 1 from the working area of the material. The groove 16 is moreover provided with a number of open channels 17 that extend from the groove 16 into the area enclosed by the inner surface 6*a*, i.e. into the material inlet. These channels 17 are provided at positions where the wings 3 are provided on the inner surface 6*a*. During use of such a center ring 1 in a defibrator any produced steam will travel towards the center ring 1, here the steam will follow the path of least resistance and end up in the pocket defined by the circumferentially running groove 16. See the cross-sectional view provided by FIG. 3. The steam will eventually evacuate the groove 16 through the channels 17. Since the channels are provided at the positions where the wings 3 are placed on the inner surface 6*a*, and since the wings 3 also perform a lifting action on the material, thus lifting the material above the outlets of the channels 17 it will be possible to reduce any interaction between incoming material flow a back-travelling steam. FIG. 3 provides an exemplary material and steam flow that can be achieved by using a center ring 1** according to the proposed technology.

Some of the embodiments contemplated herein will now be described more fully with reference to the accompanying drawings. Other embodiments, however, are contained within the scope of the subject matter disclosed herein, the disclosed subject matter should not be construed as limited to only the embodiments set forth herein; rather, these embodiments are provided by way of example to convey the scope of the subject matter to those skilled in the art.

According to a particular embodiment of the proposed technology there is provided a center ring 1, wherein the plurality of wings are provided in a symmetrical fashion along the inner surface 6*a* of the center ring 1. By providing the rings in a symmetrical fashion one increases the probabilities of obtaining a smooth material flow from the center ring 1.

According to another embodiment of the proposed technology there is provided a center ring 1 wherein the extension of each wing towards the center of the through-hole lies in the interval: [0.4×R; 0.9×R], where R denotes the radius of the through-hole. By having an extension of the wings in the suggested interval it is ensured that as large part of the incoming material is lifted up by the wings, this will in turn ensure a longer evacuation path for the steam into the inlet opening, thus ensuring that there is a reduced interaction between the back-travelling steam and the incoming material.

Yet another embodiment of the proposed technology provides a center ring 1 wherein the wings 3 have the largest height where it connects to the inner surface 6*a* of the central ring 1 and where the height gradually decreases towards the end of the wings 3 that is closest to the center of the through-hole. This particular design will provide wings 3 that ensure that the material is lifted as well as directed back towards the center of the inlet to ensure that the steam obtains a longer evacuation path from the channel openings 17 into the material inlet.

Still another embodiment of the proposed technology provides a center ring 1 wherein the width of each wing 3 decreases from a largest width where the wings contact the inner surface 6*a* of the central ring to a smallest width towards the end of the wings 3 that is closest to the center of the through-hole. This embodiment ensures that the section of the wings 3 that is impinged on by the material has a slope that smoothly lifts the material. This will ensure both that the steam obtains a longer evacuation path from the channel openings 17 into the material inlet and a smooth material flow.

By way of example, the proposed technology provides a center ring 1 wherein the plurality of wings 3 comprise wings having a curved profile and wherein the wings are provided on the inner surface 6*a* in such a way they are curved in the same direction. This embodiment will further improve the smoothness of the material flow.

Figure 4:
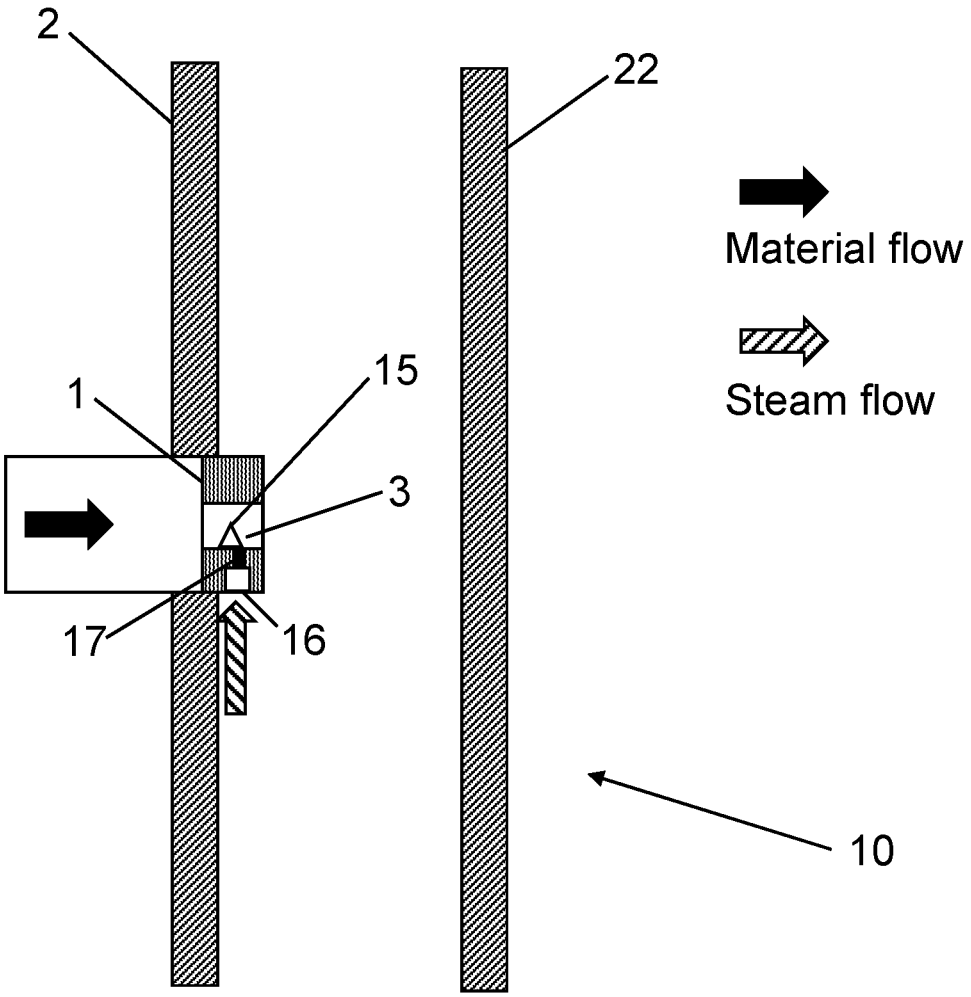
FIG. 4 is a schematic illustration of a refining disc pair where one of the refining discs is provided with a center ring according to an embodiment of the proposed technology.
Figure 5:
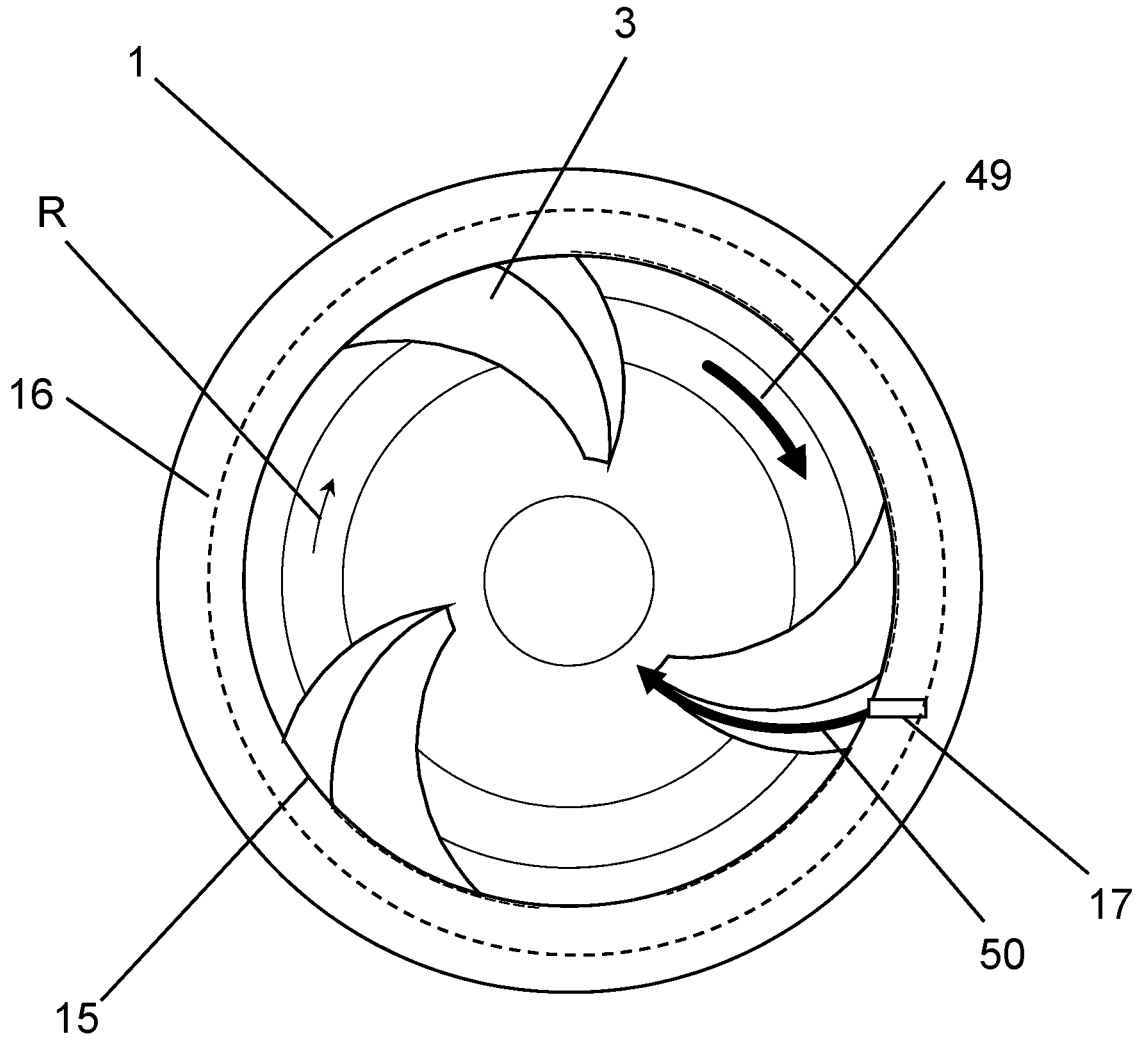
FIG. 5 is a schematic illustration of a center ring provided with wings and channels according to the proposed technology.

A particular embodiment of the proposed technology provides a center ring 1, wherein each wing 3 in the plurality of wings 3 comprises an edge 15 having a chamfered shape and wherein a channel 17 associated with a specific wing 3 is provided below the edge 15 on the side of the wing 3 that is facing in the direction opposite the direction of curvature to enable steam to evacuate the groove 16 through the channels 17 at a position below the edge 15. FIG. 3 provides a cross-sectional side of a center ring 1 that illustrates this specific embodiment. The edge 15 of the wings is arranged at a first section of the wing, where the first section is the part of the wings that, during use in a defibrator, is farthest away from the feeding device that feeds material to the material inlet zone of the center ring. That is to say, the at the highest point of the wings as seen from the incoming material. This edge 15 has a chamfered shape insofar that there is one slope upwards to the edge from one direction and a second slope downward from the same edge. The opening of the channels 17 into the material inlet zone are provided below the edge 15 and on the backside of the edge as viewed from the incoming material flow to ensure that the wings provide protection for a steam path. This will ensure that the steam can evacuate the channels 17 with a reduced interaction with the incoming material. This embodiment is also illustrated in FIG. 4 which provides a cross-sectional view from the side of pair of refining discs 2; 22 and a center ring 1. FIG. 5 provides an additional view of a center ring 1 according to this embodiment. Here it is clear how the steam evacuates the steam collecting groove 16 through channels 17 protected by the chamfered edge 15. Also illustrated is how the curved shape of the wings 3 ensures that the material in the material flow, the latter denoted 39, is lifted to ensure that there is a reduced interaction between the incoming material and the back-travelling steam, the latter denoted 50 in the drawing. That is, the material flow 39 follows the rotational motion R of the feeding device and when it impinges on a wing 3 it is raised or lifted by the shape of the wing. By providing the channels on the opposite side of the wing 3, and below the chamfered edge, the steam will evacuate the groove protected by the wing 3 to avoid any contact with the material flow.

Figure 6:
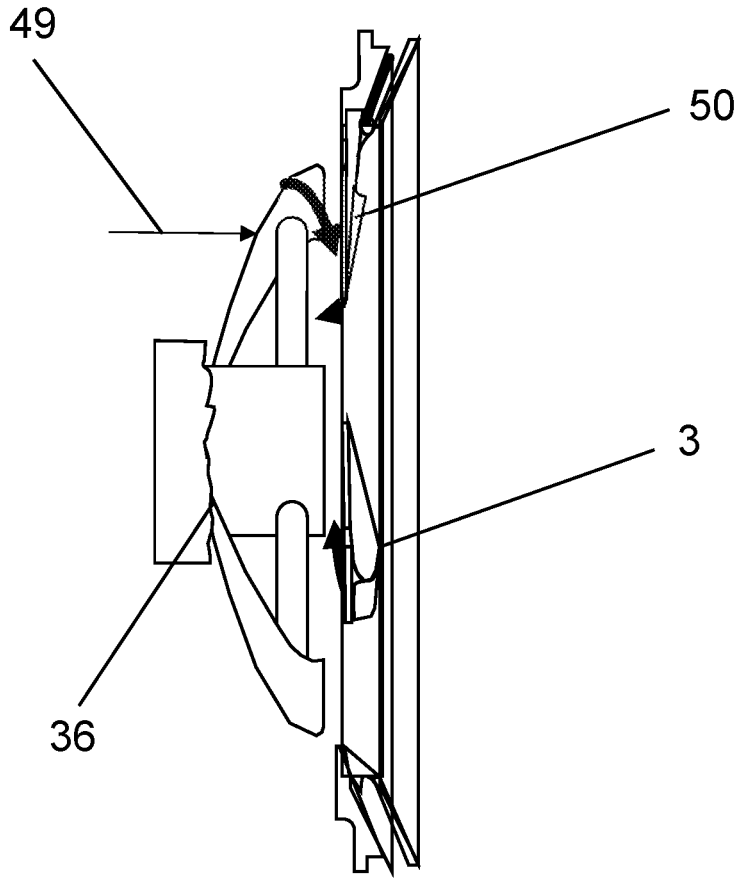
FIG. 6 is a cross-sectional side view of the center ring illustrated in FIG. 5.

FIG. 6 provides a cross-sectional side view of the center ring 1 illustrated in FIG. 5. The drawing illustrates a material and steam flow that can be obtained by this particular embodiment. A material flow 49 is forced into the center ring 1 by a feeding device in the shape of a ribbon feeder 36. The wings 3 acts to lift the material upwards and provide protection for the steam flow 50 to evacuate the groove through channels.

Figure 7:
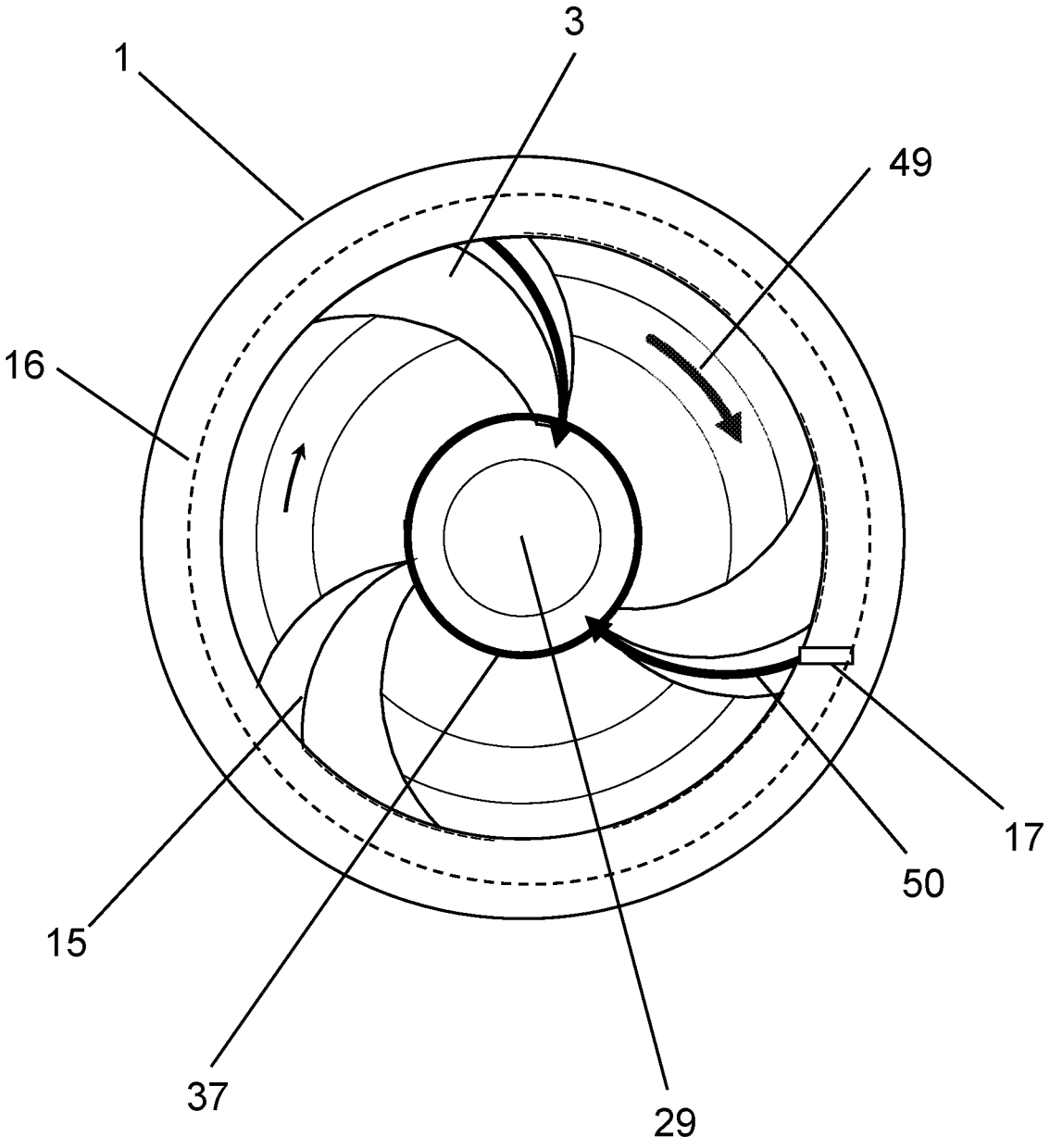
FIG. 7 is a schematic illustration center ring provided with curved wings and channels according to the proposed technology.

A particular embodiment of the proposed technology provides a center ring 1 wherein the ends of the plurality of wings 3 that are closest to the center of said through-hole are interconnected by a reinforcing structure 37. This embodiment is schematically illustrated in FIG. 7. The reinforcing structure 37 provides additional strength to the wing arrangement and provides additional protection against the substantial forces the wings may experience during operation of the defibrator. The reinforcing structure 37 may be a hard material ring that are attached to all wings at their ends. The structure may however display any geometrical shape. The number of wings used determines the most suitable shape.

The present disclosure has described a number of embodiments of a center ring 1 that enables a reduction of interactions between incoming material flow and back-travelling steam.

The present disclosure has described a number of embodiments of a center ring 1 that enables a reduction of interactions between incoming material flow and back-travelling steam, it should however also be noted that the proposed technology also provides a refining disc 2 of a defibrator 10 for refining of fibrous material, where the refining disc 2 comprising a center ring 1 according to what has been described above. The refining disc 2 may in particular a stator disc.

The proposed technology also provides a refining disc 2 wherein the center ring 1 is arranged on the refining disc so that the rotational center of the center ring coincide with the rotational center of the refining disc and so that the center ring 1 faces a second refining disc 22 arranged opposite the refining disc 2 during use in a defibrator.

The proposed technology also relates to a defibrator for refining lignocellulosic material, where the defibrator comprises two oppositely arranged refining discs wherein one of the refining discs is a refining disc according to what has been described above.

The proposed technology also provides a stator plate comprising a center ring 1 according to what has been described above. A stator plate, or a stator, is the structure in a defibrator that carries the stator refining disc. The present embodiment thus provides an alternative fastening structure for attaching the center ring 1 to the defibrator.

The invention claimed is:

1. A center ring arrangeable on a refining disc of a defibrator for refining of fibrous material, the center ring comprising:

a circumferential outer surface;

a circumferential inner surface; and a centrally located through-hole adapted to receive fibrous material fed from a feeding device;

wherein the circumferential outer surface is provided with a circumferentially running groove opening up on the circumferential outer surface and being adapted to collect steam produced during operation of the defibrator; and wherein the center ring further comprises:

a plurality of wings provided on the circumferential inner surface, and a plurality of channels extending from the circumferentially running groove to positions on the circumferential inner surface where the wings are provided.

2. The center ring of claim 1, wherein the wings are provided in a symmetrical fashion along the circumferential inner surface of the center ring.

3. The center ring of claim 1, wherein an extension of each of the wings towards a center of the centrally-located through-hole lies in the interval: [0.4×R; 0.9×R], where R denotes a radius of the centrally-located through-hole.

4. The center ring of claim 1, wherein:

the wings include curved wings, each of the curved wings having a curved profile; and the curved wings are provided on the circumferential inner surface in such a way they are curved in the same direction.

5. The center ring of claim 1, wherein ends of the wings that are closest to a center of the centrally-located through-hole are interconnected by a reinforcing structure.

6. A refining disc of a defibrator for refining of fibrous material, the refining disc comprising the center ring of claim 1.

7. The refining disc of claim 6, wherein the refining disc is a stator disc.

8. The refining disc of claim 6, wherein the center ring is arranged on the refining disc so that a rotational center of the center ring coincides with the rotational center of the refining disc and so that the center ring faces a second refining disc arranged opposite the refining disc during use in a defibrator.

9. A defibrator for refining lignocellulosic material, the defibrator comprising two oppositely arranged refining discs, wherein one of the refining discs is the refining disc of claim 6.

10. A stator plate comprising the center ring of claim 1.

* * * * *